United States Patent [19]

Jones

[11] Patent Number: 4,864,669

[45] Date of Patent: Sep. 12, 1989

[54] ATRAUMATIC PILLOW AND PILLOWCASE

[76] Inventor: Charles L. Jones, 105 Lake Emerald Dr., Apt. 603, Oakland Park, Fla. 33309

[21] Appl. No.: 305,717

[22] Filed: Feb. 3, 1989

[51] Int. Cl.[4] ..... A47G 9/00

[52] U.S. Cl. ..... 5/434; 5/490

[58] Field of Search ..... 5/490, 434, 436, 441, 5/502, 470, 451; 297/219, 220

[56] References Cited

U.S. PATENT DOCUMENTS 3,423,774 1/1969 Streetman ..... 5/490

3,574,873 4/1971 Weinstein ..... 5/451

*Primary Examiner*—Alexander Grosz

*Attorney, Agent, or Firm*—Alvin S. Blum

[57] ABSTRACT

A pillow and pillow cover are provided that are less traumatic to the skin and hairdo of the user by providing an outer covering that slides readily over a non-friction inner cover. When the skin is pressed against the cover and the user turns in sleep, the outer cover moves with the skin instead of rubbing against the skin. The outer cover is constructed to move freely over the inner cover to provide this freedom of movement.

16 Claims, 1 Drawing Sheet

ATRAUMATIC PILLOW AND PILLOWCASEFIELD OF THE INVENTION

This invention relates to bedding, and more particularly to a pillow and pillow covering that reduce the trauma to the skin of the user from moving the face while resting on the pillow through unique structure of the covering of the pillow.

BACKGROUND OF THE INVENTION

The human head is quite heavy. When the body is relaxed in sleep, the weight of the head presses against the pillow with considerable force. If the face is against the pillow when the sleeper turns, the skin of the face is rubbed forcefully across the fabric covering of pillows of the prior art. The continuous trauma of this rubbing over so many hours of sleep in a lifetime is damaging to the skin of some individuals. It is especially injurious to a person after injury or surgery, such as cosmetic surgery. It is preferable to leave injured skin open to the air to promote healing, but bandages may be required to protect the skin from sleeping injury by conventional pillows. The invention reduces trauma to the skin by providing an outer layer of pillow covering that moves freely with the skin by sliding over a slick or slippery under layer that remains unmoving with the pillow itself. U.S. Pat. No. 2,884,652 issued 5/5/59 to Paolicelli and U.S. Pat. No. 2,779,033 issued 1/29/57 to Fountain teach novel pillow coverings that do not address the trauma issue. U.S. Pat. Nos. 4,546,516 and 4,493,866 issued on 10/15/85 and 1/15/85 to Kim teach cosmetic towels with an outer layer that slides on an inner layer for drying without rubbing and U.S. Pat. Nos. 4,615,188 issued 10/7/86 to Hursh and 4,341,096 issued 7/27/82 to Safrit et al. teach socks with a sliding outer surface layer to prevent chafing. However, no prior art addresses the problem of trauma from sleeping on conventional pillows nor the pillows and pillowcases of the instant invention that solve the problem.

SUMMARY OF THE INVENTION

It is accordingly an object of the invention to provide a pillow and pillow cover that will be less injurious to the user's skin when resting and turning thereon by providing an outer layer that can move freely with the skin by sliding over a slick inner layer.

It is yet another object that the outer layer be more comfortable with softness and moisture absorbance properties wherein an inner layer or layers may provide properties more protective of the pillow.

It is yet another object that the outer layer be more freely movable and the inner layer or layers more firmly anchored to the pillow and less freely movable and present a low friction surface to the outer layer so that the outer layer may move more freely with the skin without rubbing or pulling against the skin.

It is yet another object that the pillow reduce pulling on a coiffure. The pillow and pillowcase of the invention include an outer covering with a surface compatible with the skin. The outer covering is sufficiently larger than the inner elements that it can move freely back and forth without pulling on the inner elements. An inner layer presents a low friction surface to the outer layer.

These and other objects, advantages and features of the invention will become more apparent when considered in combination with the following illustrations and detailed description.

DETAILED DESCRIPTION OF PREFERRED EMBODIMENTS

Figure 1:
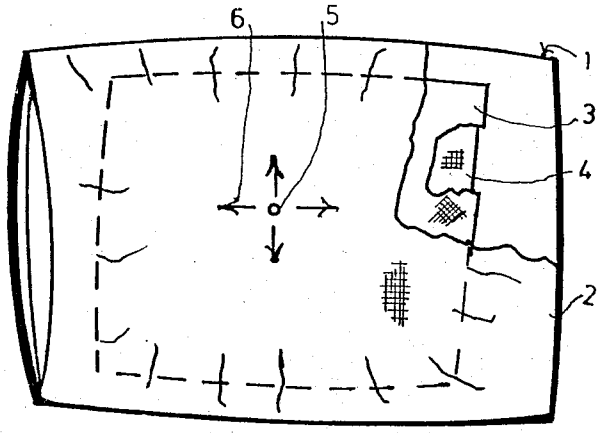
FIG. 1 is a perspective view of the pillow of FIG. 1 with a portion of the outer covering cut away.

Referring now first to FIG. 1, a covered pillow 1 of the invention is shown with a portion of outer cover 2 broken away to reveal the inner cover 3. The outer cover 2 may be of a fine soft moisture absorbing cottom fabric or other material comfortable and compatible with the skin. The inner cover 3 may be of a slick, slippery or low friction material such as the nylon fabric of ladies hose. This nylon fabric is slick and smooth and yet readily transfers moisture so that perspiration is not trapped against the skin. The dimensions of the outer cover 2 are much greater than that of the inner cover 3 that holds the pillow 4, so that any point 5 on outer cover 2 may be moved with the skin a considerable distance in any direction as indicated by arrows 6 without pulling on the outer margins of the inner cover 3.

Figure 2:
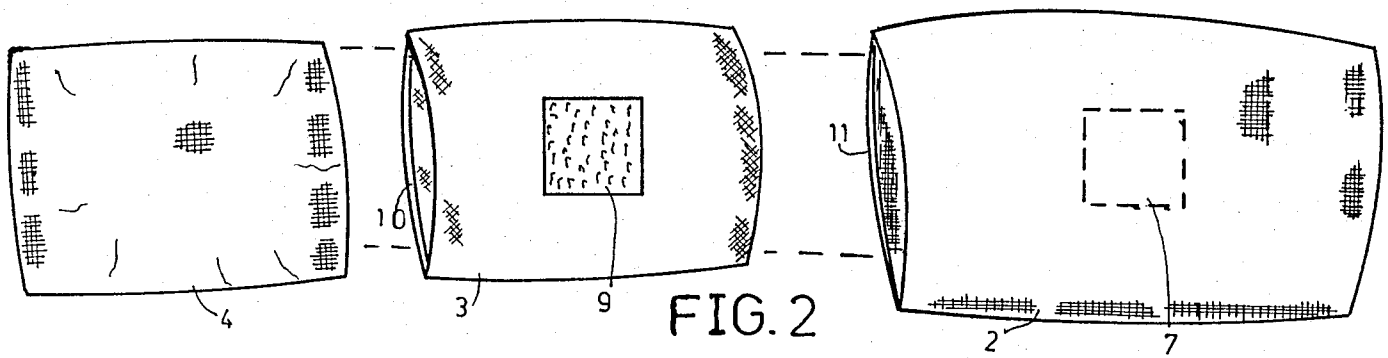
FIG. 2 is an expanded drawing of the pillow in perspective showing how three elements are assembled.

FIG. 2 shows the underside of the assembly, that is the portion resting on the mattress is shown uppermost. The inner cover 3 is anchored to the outer cover 2 at a central area 7. This may be by sewing the two together at this area. Alternatively, they may be anchored together at this area by other means well known in the art such as hook-and-loop fastening means 9. This fastening means has the advantage that the two covers are readily separated and the outer cover 2 may be replaced or laundered more frequently. Inner pillow 4 is held in inner cover by conventional means. Closures 10 and 11 may be provided to close the openings in covers 3 and 2 respectively. The covering on inner pillow 4 may have special properties such as a coarse mesh to enhance air and moisture circulation. The inner cover 2 may be the permanent surface of pillow 4. Alternatively, the inner pillow 4 may be pneumatic to better conform and yield to body structures to distribute forces and reduce local pressure on any body part.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea of principles of the invention within the scope of the appended claims.

I claim:

1. A pillow cover means for providing reduced trauma to a user by having an outer surface that moves with the skin or hair of a user to prevent rubbing against the body surface, said pillow cover means comprising:

(a) a first, outer cover means having two broad main surfaces and four edges and having an exterior surface compatible with the skin of said user, said outer cover means having dimensions large enough to substantially totally enclose said pillow with sufficient extra room between said pillow and said edges to enable free movement of said outer cover means in all directions;

(b) a second, inner cover means for fitting inside said first, outer cover means and closely fitting over said pillow to limit movement between said inner cover means and said pillow, said inner cover means having a low friction outer surface in contact with said outer cover means; and (c) connecting means connecting said first, outer cover means to said second, inner cover means at a generally central area of one of said main surfaces, wherein said connecting means may be located below said pillow to provide a freely movable upper surface of said first outer cover means with freedom of movement between said edges and said pillow to provide the necessary space for outer cover means movement when the user's head is resting on said pillow during movement.

2. The pillow cover means according to claim 1, in which said connecting means removably connects said first and second cover means to enable separation for replacement and laundering.

3. The pillow cover means according to claim 2, in which said connecting means are of the hook and loop type.

4. The pillow cover means according to claim 1, further including a third, cover means between said second, inner means and said pillow having properties for improved air and moisture circulation.

5. The pillow cover means according to claim 1, in which said second, inner cover means is a smooth, slick nylon fabric.

6. The pillow cover means according to claim 5, in which said first, outer cover means is a cotton fabric.

7. A pillow with a resilient inner element providing reduced trauma to a user by having an outer surface that moves with the skin or hair of a user to prevent rubbing against the body surface, said pillow comprising:

(a) a first, outer cover having two broad main surfaces and four edges and having an exterior surface compatible with the skin of said user, said outer cover means having dimensions large enough to substantially totally enclose said pillow with sufficient extra room between said inner element and said edges to enable free movement of said outer cover means in all directions;

(b) a second, inner cover means for fitting inside said first outer cover means and closely fitting over said inner element to limit movement between said inner cover means and said inner element, said inner cover means having a low friction outer surface in contact with said outer cover means; and (c) connecting means connecting said first, outer cover means to said second, inner cover means at a generally central area of one of said major surfaces, wherein said connecting means may be located below said inner element to provide a freely movable upper surface of said first, outer cover means with freedom of movement between said edges and said inner element to provide the necessary space for outer cover means movement when the user's head is resting on said pillow during movement.

8. The pillow according to claim 7, in which said connecting means removably connects said first and second cover means to enable separation for replacement and laundering.

9. The pillow means according to claim 8, in which said connecting means are of the hook and loop type.

10. The pillow according to claim 7, further including a third, cover means between said second, inner means and said inner element having properties for improved air and moisture circulation.

11. The pillow according to claim 7, in which said second, inner cover means is a smooth, slick nylon fabric.

12. The pillow according to claim 11, in which said first, outer cover means is a cotton fabric.

13. The pillow according to claim 7, in which said resilient inner element is pneumatic.

14. The pillow according to claim 7, in which said resilient inner element is fibrous.

15. The pillow according to claim 7, in which said resilient inner element is a foam composition.

16. The pillow according to claim 7, in which said resilient inner element includes feathers.

* * * * *